US011266250B2

(12) United States Patent
Blanc

(10) Patent No.: US 11,266,250 B2
(45) Date of Patent: Mar. 8, 2022

(54) INFLATABLE PILLOW

(71) Applicant: DG International Holdings Limited, London (GB)

(72) Inventor: Cedric Henri Nicolas Blanc, London (GB)

(73) Assignee: DG International Holdings Limited, London (GB)

( * ) Notice: Subject to any disclaimer, the term of this patent is extended or adjusted under 35 U.S.C. 154(b) by 0 days.

(21) Appl. No.: 16/562,954

(22) Filed: Sep. 6, 2019

(65) Prior Publication Data

US 2020/0077802 A1 Mar. 12, 2020

(30) Foreign Application Priority Data

Sep. 7, 2018 (GB) ..... 1814599

(51) Int. Cl.
*A47C 16/00* (2006.01)
*A47G 9/10* (2006.01)

(52) U.S. Cl.
CPC ..... *A47C 16/00* (2013.01); *A47G 9/1027* (2013.01); *A47G 9/1081* (2013.01)

(58) Field of Classification Search
CPC .. A47C 16/00; A47C 7/36; A47C 7/38; A47C 7/383; A47G 9/1027; A47G 9/1081
See application file for complete search history.

(56) References Cited

U.S. PATENT DOCUMENTS 2,589,155 A 3/1952 Smith
5,544,378 A 8/1996 Chow
5,645,319 A 7/1997 Parks, Jr.
10,426,242 B1 * 10/2019 Little ..... A45F 4/02
2002/0108181 A1 8/2002 Brown et al.
2006/0267392 A1 * 11/2006 Charnitski ..... A47C 7/383 297/393
2008/0034504 A1 2/2008 Schmidt
2009/0013471 A1 * 1/2009 Yang ..... A47C 27/086 5/640
2010/0205744 A1 * 8/2010 Edwards ..... A47C 7/383 5/644
2012/0255126 A1 * 10/2012 Abdo ..... A47G 9/109 5/638
2013/0198961 A1 * 8/2013 Davis ..... A47C 7/18 5/648
2014/0007351 A1 * 1/2014 Cohen ..... A47G 9/0253 5/639
2014/0123394 A1 * 5/2014 Rowland ..... A47C 7/383 5/644
2014/0209184 A1 * 7/2014 Frayne ..... A47C 27/088 137/223
2017/0127858 A1 * 5/2017 Teh ..... A47G 9/1045
2017/0318991 A1 * 11/2017 Loftus ..... A47C 7/467
2017/0332812 A1 * 11/2017 Colton ..... A47G 9/10

FOREIGN PATENT DOCUMENTS

CN 102452338 A 5/2012
WO 2003039325 A2 5/2003

* cited by examiner

*Primary Examiner* — Peter M. Cuomo
*Assistant Examiner* — George Sun
(74) *Attorney, Agent, or Firm* — Budzyn IP Law, LLC

(57) ABSTRACT

The invention provides an inflatable pillow or cushion that is configured to transition between a deflated state in which the pillow conforms to a substantially planar profile within at least one plane, and an inflated state in which the pillow conforms to a non-planar profile within the at least one plane.

18 Claims, 19 Drawing Sheets

INFLATABLE PILLOW

FIELD OF THE INVENTION

The invention relates to inflatable pillows and cushions—and in particular to inflatable travel pillows that are ergonomically designed to provide a cushion support for a user's head and neck, while simultaneously offering improved user comfort, and cost and manufacturing efficiencies.

BACKGROUND

For the purposes of the description below, the terms "cushion" and "pillow" may be used interchangeably and shall be understood as referring to an object configured to provide cushioning support or padded support to portions of a user's anatomy that are in contact with the object.

Inflatable pillows are manufactured in several different forms. The most straightforward inflatable pillows are manufactured in a substantially rectangular shape and can be inflated to provide cushioned support for a user's head.

An improvement to the basic pillow shape is the neck pillow—comprising an inflatable pillow having a substantially u-shaped or v-shaped profile. When inflated, such pillows function like a collar, permitting the pillow to be positioned around the user's neck. Typically, neck pillows are adapted for use by individuals resting in an inclined or seated position.

In their most basic embodiments, inflatable neck pillows comprise two or more sheets of pliant or flexible airtight (i.e. substantially air impermeable) material joined together to define an air chamber that can be inflated to provide cushioned support.

FIG. 1 illustrates an embodiment of an inflatable neck pillow 100 of a type known in the prior art. The neck pillow 100 is configured so as to include a central head rest or neck rest region 102 and two wing regions 104 and 106 that are oriented substantially normal to a longitudinal axis "a" of the head/neck rest region 102. The configuration of the head/neck rest region 102 and wing regions 104 and 106 relative to each other forms a substantially u-shape or collar that is capable of being fitted about a user's neck. As discussed above, neck pillow 100 may be manufactured by joining two or more pliant airtight sheets, each having been cut to the desired u-shape—wherein the joining is achieved through welds (or seams) 110 and 112 used to join the two (or more) sheets together. The joining of the sheets results in a substantially u-shaped air chamber created between the sheets—which air chamber can be inflated to give the neck pillow 100 an inflated configuration. The neck pillow 100 may additionally include one or more inflation valves (not shown) through which air can be introduced into the air chamber for inflating the neck pillow 100.

FIGS. 2 and 3 respectively show side and front views of a prior art neck pillow 100 in use. It will be particularly noted from FIG. 3, that owing to its position between the two (i.e. the upper and lower) airtight sheets 114, 116 that have been affixed together, weld 112 comes in contact with the user's neck during use—resulting in user discomfort. While internal welds are a possibility to join the sheets of airtight material together, even such internal welds eventually result in chafing sensations and discomfort to the user.

Another obstacle presented by conventional inflatable neck pillow configurations is that, while using a weld to join top and bottom halves of an inflatable neck pillow enables the pillow to be configured to have a u-shaped horizontal profile, this configuration invariably results in the vertical profile of the pillow being substantially symmetrical upon inflation. In other words, inflation of the pillow results in both the top and bottom halves of the pillow assuming a substantially symmetrical configuration (each half being substantially symmetrical to the other)—which interferes with providing contoured support for a user's chin, jaw and shoulder regions. While internal welds or seams could be used to shape the vertical profile of inflatable pillows—such shaping solutions are more complex and therefore expensive to implement during manufacture.

There is accordingly a need for an inflatable neck pillow that can achieve a collar shaped configuration without bringing weld regions of the pillow in contact with the user's neck or in contact with other regions of the user's anatomy, and which simultaneously offers cost and manufacturing efficiencies.

SUMMARY

The invention provides an inflatable pillow or cushion that implements one or more constriction structures located on or within the inflatable pillow or cushion. The constriction structures are configured to form one or more flexible hinges within the body of the inflatable pillow or cushion—and the one or more hinges enable the pillow or cushion to transition between (i) a deflated state in which the pillow conforms to a substantially planar profile within at least one plane, and (ii) an inflated state in which the pillow conforms to a non-planar profile within the at least one plane. In particular embodiments of the invention, the constriction structures are configured (i) such that when the pillow is an inflated state, the constriction structures urge the pillow from a substantially planar profile within at least one plane to a non-planar profile within the at least one plane, and/or (ii) such that when the pillow is in an inflated state and conforms to a non-planar profile within at least one plane, the constriction structures resist transition of the pillow from the non-planar profile within the at least one plane towards a substantially linear profile within the at least one plane.

In an embodiment, the invention provides a pillow, comprising at least two flexible sheets joined together to form a pillow body. The pillow body comprises at least a bridge, a first wing and a second wing. The joined flexible sheets define an internal fluid chamber extending through the bridge and the first and second wings.

A first constriction may be formed between the bridge and the first wing. The first constriction comprises a first constriction structure configured to form a first restricted cross section region within the internal fluid chamber at a junction between the bridge and the first wing. An internal cross-sectional area of a narrowest part of the first restricted cross section region may be smaller than an internal cross sectional area of at least one of the widest part of the bridge and the widest part of the first wing.

A second constriction may be formed between the bridge and the second wing. The second constriction may comprise a second constriction structure configured to form a second restricted cross section region within the internal fluid chamber at a junction between the bridge and the second wing. An internal cross-sectional area of a narrowest part of the second restricted cross section region may be smaller than an internal cross sectional area of at least one of the widest part of the bridge and the widest part of the second wing.

The first and second constriction structures may be configured enable the pillow to transition between a deflated state in which the pillow body conforms to a planar profile within at least one plane, and an inflated state in which the pillow conforms to a non-planar profile within the at least one plane.

The first and second constriction structures may be configured such that when the pillow is in an inflated state and conforms to a non-planar profile within at least one plane, one or both of the first and second constriction structures resist transition of the pillow from the non-planar profile within the at least one plane towards a substantially linear profile within the at least one plane.

In an embodiment, the first and second constriction structures may be configured such that when the pillow is an inflated state, one or both of the first and second constriction structures urge the pillow from a substantially planar profile within at least one plane to a non-planar profile within the at least one plane.

The first and second constriction structures may be configured such that when the pillow is in an inflated state, first and second wing sections are urged towards each other.

One or both of the first and second constriction structures may be configured to join the flexible sheets together at one or more regions located between opposing peripheral seams of the pillow.

In an embodiment, one or both of the first and second constriction structures are configured to modify inflation responsive expansibility exhibited by of one or both of the flexible sheets in comparison with the inflation responsive expansibility exhibited by said one or both sheets in absence of such constriction.

In a specific embodiment one or both of the first and second constriction structures are configured to restrict inflation responsive separation of the flexible sheets relative to each other.

In one embodiment, responsive to the pillow being in an inflated state, one or both of the first and second constriction structures predisposes the pillow body to bend in a specific orientation. Responsive to the pillow being in an inflated state, one or both of the first and second constriction structures predisposes the pillow body to resist bending away from a specific orientation.

In a particular embodiment of the pillow, the first constriction may be formed at a first constriction region between the bridge and the first wing. The first constriction structure may be configured such that in an inflated state of the pillow, pliancy of the pillow body at the first constriction region is higher than pliancy of at least one of the bridge and the first wing.

In an embodiment, the second constriction may be formed at a second constriction region between the bridge and the second wing. The second constriction structure may be configured such that in an inflated state of the pillow, pliancy of the pillow body at the second constriction region is higher than pliancy of at least one of the bridge and the second wing.

The first constriction structure may be configured such that in a deflated state of the pillow, pliancy of the pillow body at the first constriction region is substantially equal to pliancy of at least one of the bridge and the first wing. The second constriction structure may be configured such that in a deflated state of the pillow, pliancy of the pillow body at the second constriction region is substantially equal to pliancy of at least one of the bridge and the second wing.

When the pillow is in a deflated state, the bridge and first and second wings may conform to a linear profile within the at least one plane. When the pillow is in an inflated state, each of the first and second wing may be oriented at an angle to the bridge within the at least one plane.

Each of the first constriction structure and the second constriction structure may define at least one additional restricted cross section region within the internal fluid chamber at a junction between the bridge and an adjacent first wing or second wing. An internal cross-sectional area of a narrowest part of the additional restricted cross-section region may be smaller than a cross sectional area of at least one of the widest part of the bridge and the widest part of the adjacent wing.

Each of the first constriction structure and the second constriction structure may comprise a fluid impermeable structure formed between the two flexible sheets.

The fluid impermeable structure may comprise a fluid impermeable weld joining the two flexible sheets.

In an embodiment, each of the first constriction structure and the second constriction structure comprises an inwardly formed indentation one or both of the two flexible sheets.

A distance between the first constriction structure and a furthest point on a periphery of the first wing may in an embodiment be equal to a distance between the second constriction structure and a furthest point on a periphery of the second wing.

In an embodiment of the pillow, pillow body is an elongate body, and the first and second wings are each connected to the bridge in a laterally opposed configuration.

In a preferred embodiment, the pillow may comprise one or more of an inflation inlet, and a closure configured to enable edges of the first wing and the second wing to be removably affixed together.

BRIEF DESCRIPTION OF THE ACCOMPANYING DRAWINGS

DETAILED DESCRIPTION

The present invention addresses the problems in the prior art by providing an inflatable pillow or inflatable cushion that implements one or more constriction structures located within an air chamber of the inflatable pillow or cushion. The constriction structures form one or more flexible hinges or pneumatically actuatable hinges (or hinge regions) within the body of the inflatable pillow or cushion—and the one or more hinges or hinge regions enable the pillow or cushion to transition between (i) a deflated state in which the pillow conforms to a first substantially planar profile within at least one plane, and (ii) an inflated state in which the pillow conforms to a non-planar profile within the at least one plane. In particular embodiments of the invention, the hinges or hinge regions are configured (i) such that when the pillow is an inflated state, the hinges or hinge regions urge the pillow from a substantially planar profile within at least one plane to a non-planar profile within the at least one plane, or (ii) such that when the pillow is in an inflated state and conforms to a non-planar profile within at least one plane, the hinges or hinge regions resist transition of the pillow from the non-planar profile within the at least one plane towards a substantially linear profile within the at least one plane.

FIGS. 4A to 4F illustrate an inflatable pillow 400 configured in accordance with the teachings of the present invention. While the embodiments of the inflatable pillow 400 shown in FIGS. 4A to 4F comprise a neck pillow, it would be understood that the teachings and principles discussed below are equally applicable to any other inflatable pillow or inflatable cushion.

Figure 1:
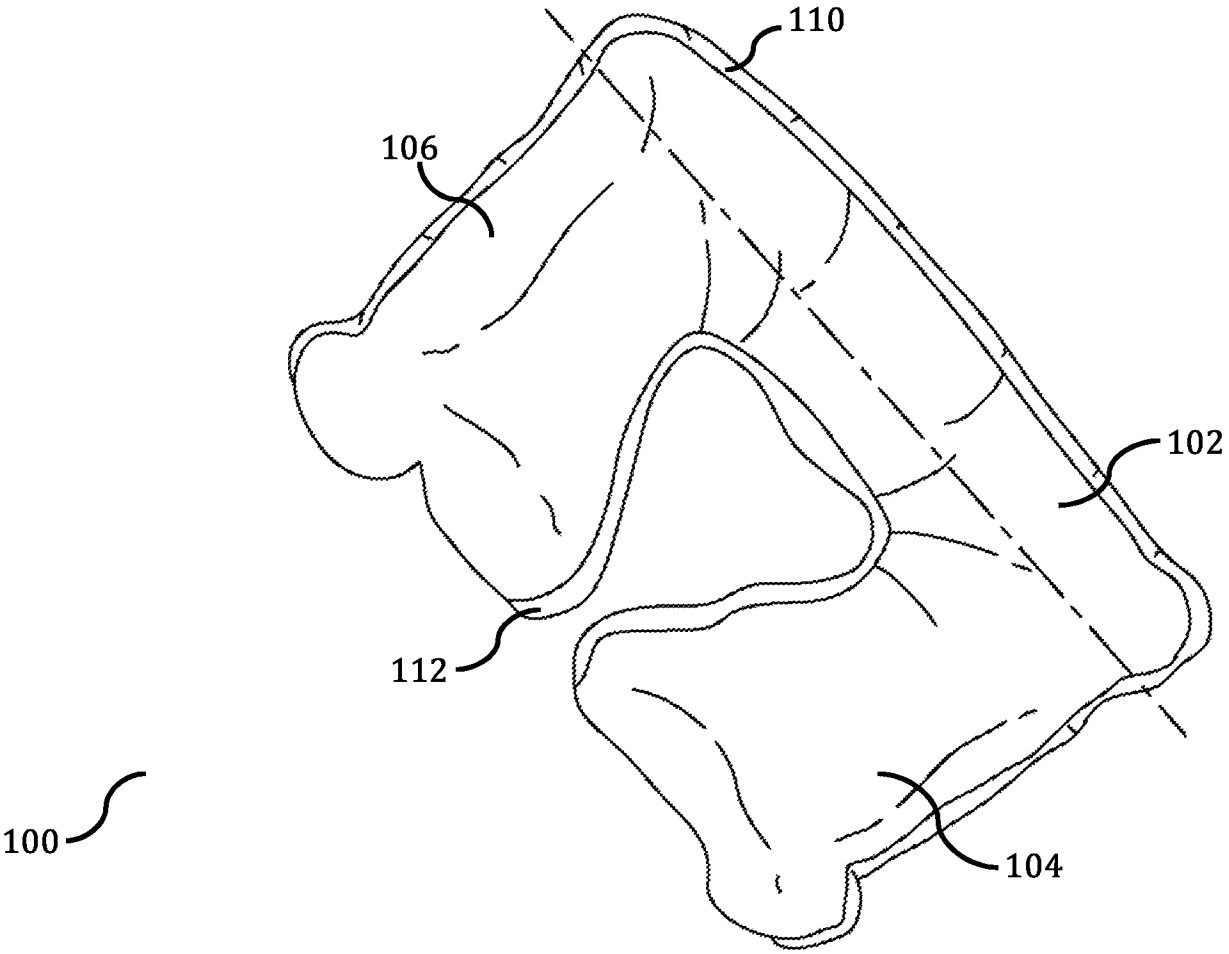
Figure 1 (prior art)
FIGS. 1 to 3 illustrate prior art inflatable pillows.
Figure 2:
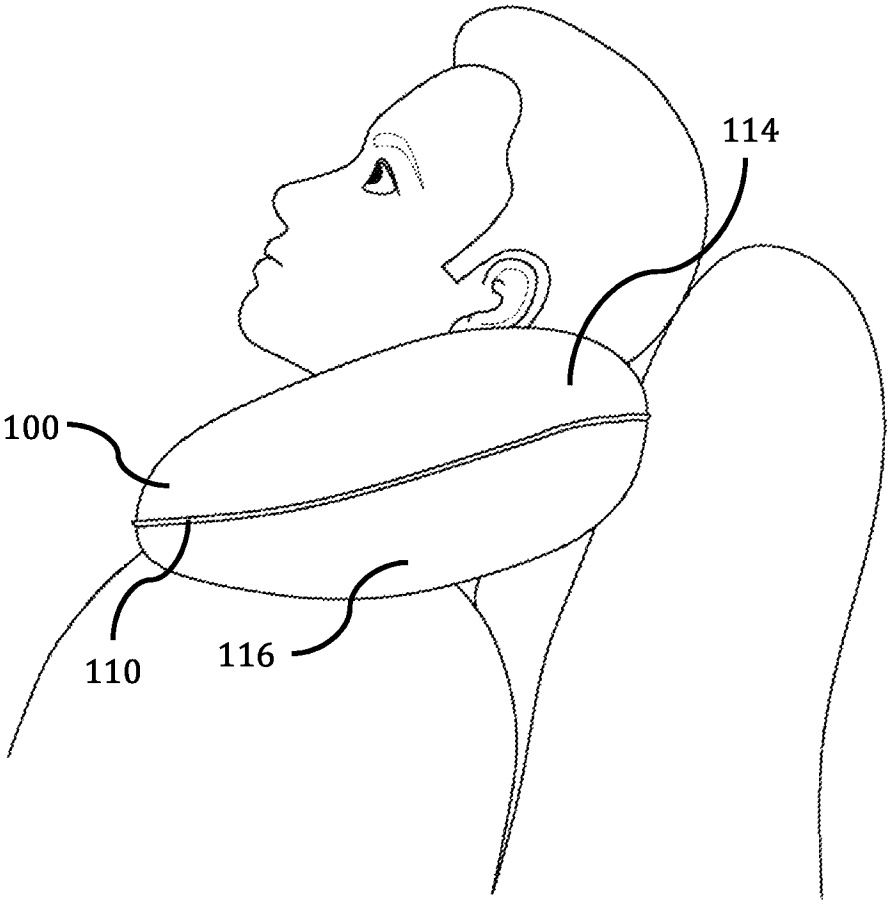
Figure 2 (prior art)
Figure 3:
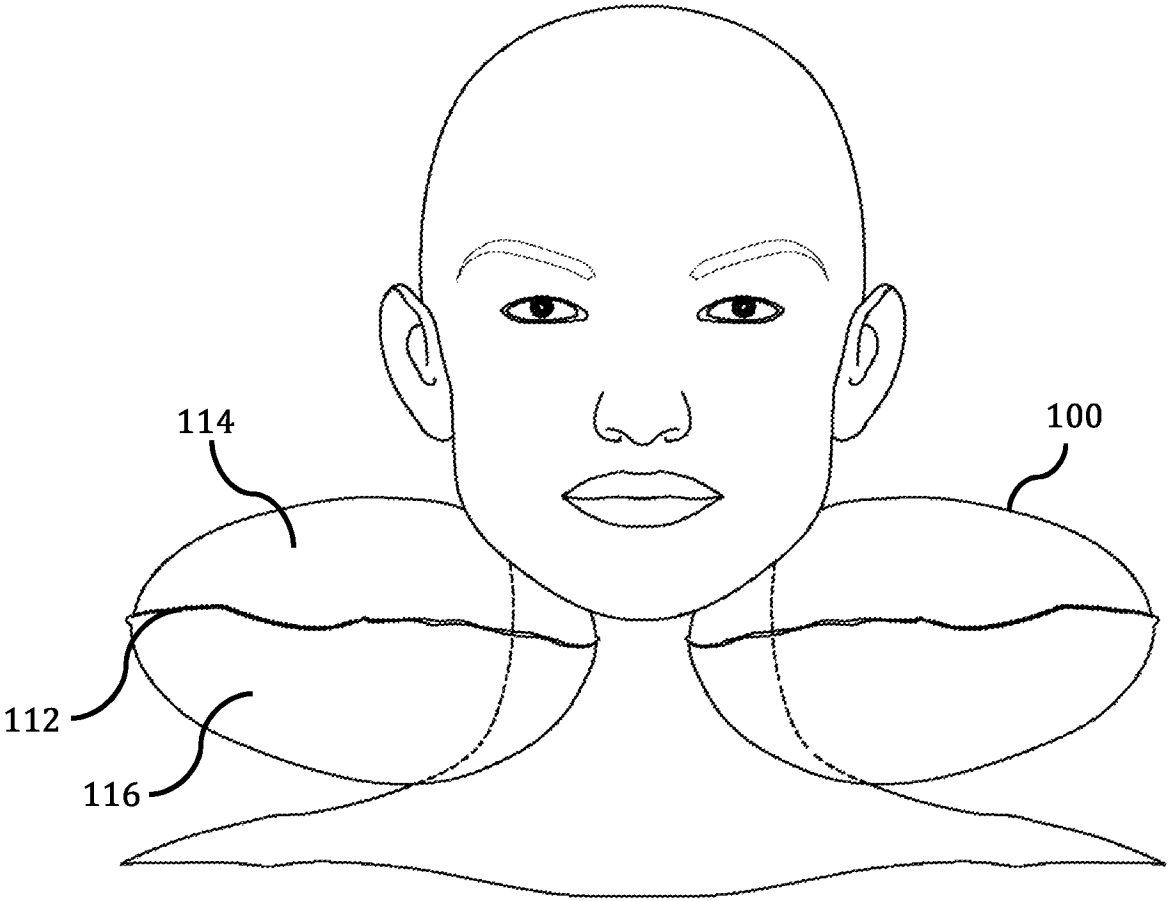
Figure 3 (prior art)
Figure 4A:
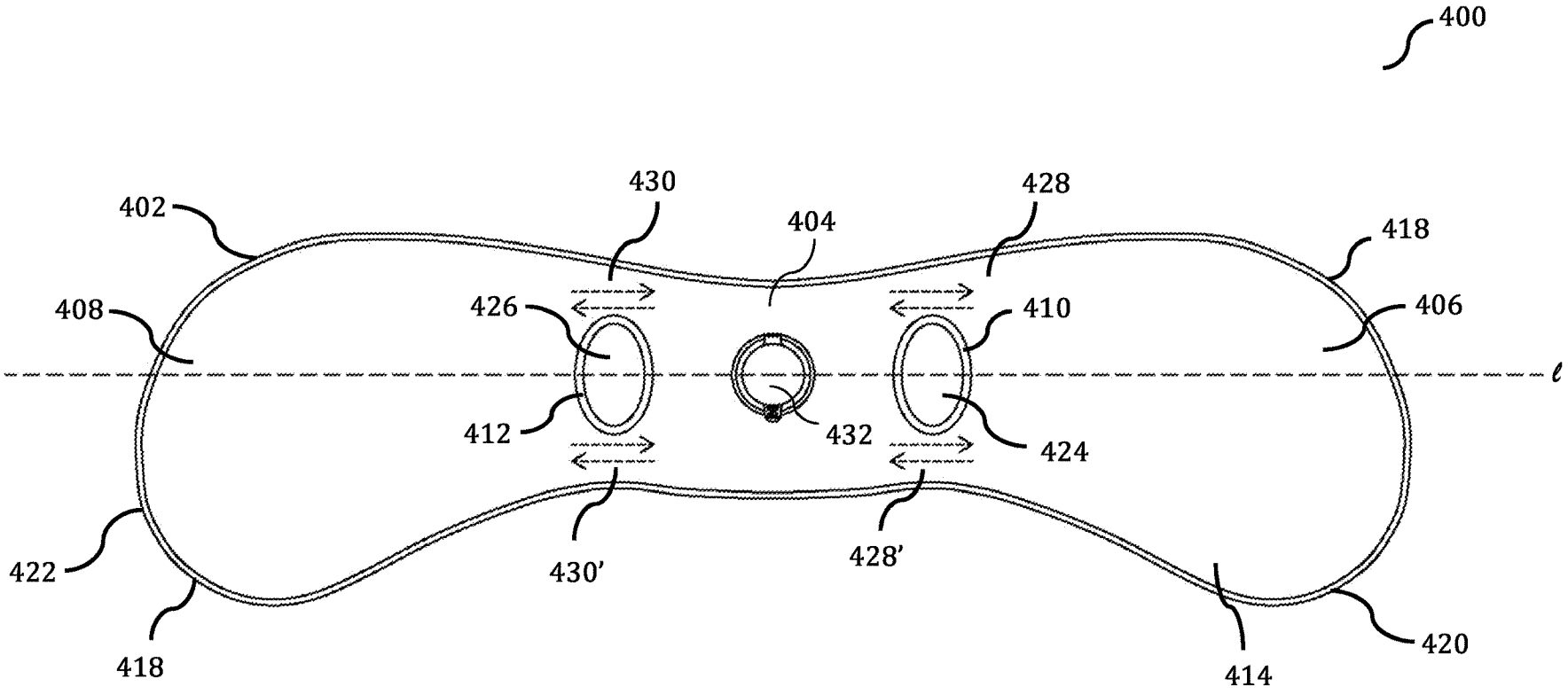
FIGS. 4A to 4G and FIG. 6 illustrate embodiments of an inflatable pillow configured in accordance with the teachings of the present invention.
Figure 4B:
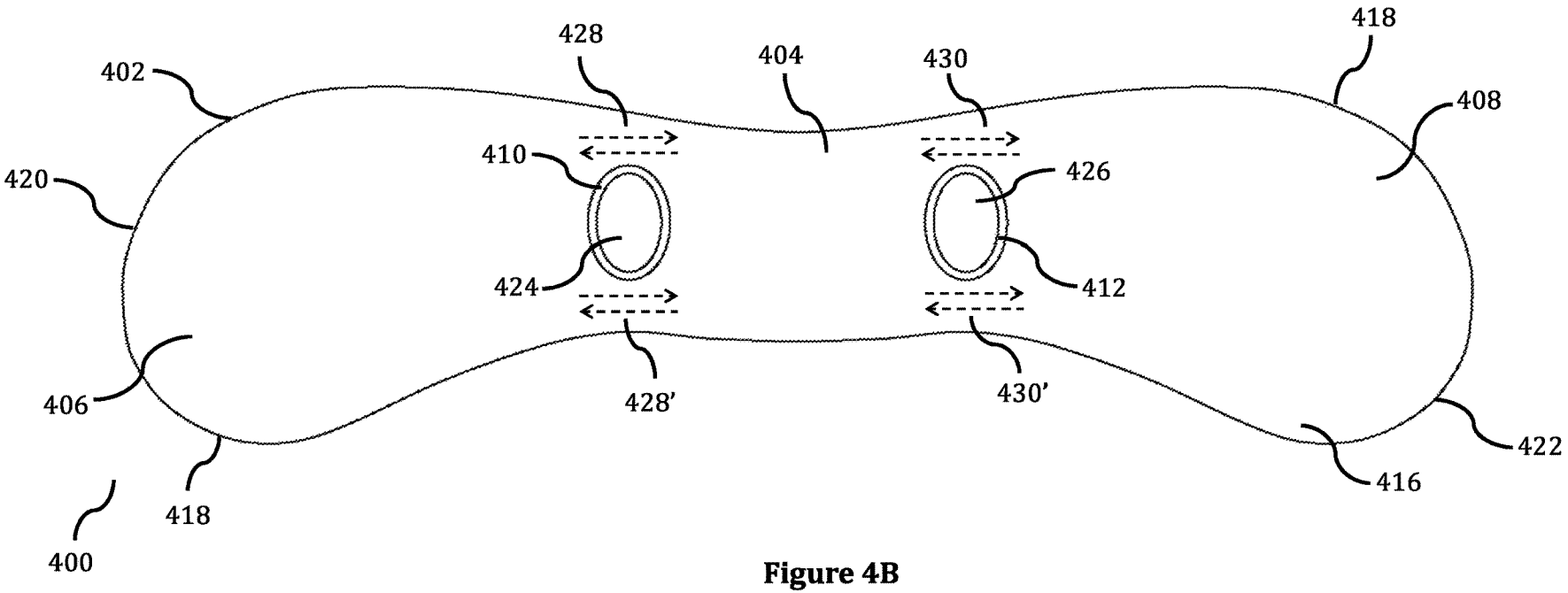
Figure 4C:
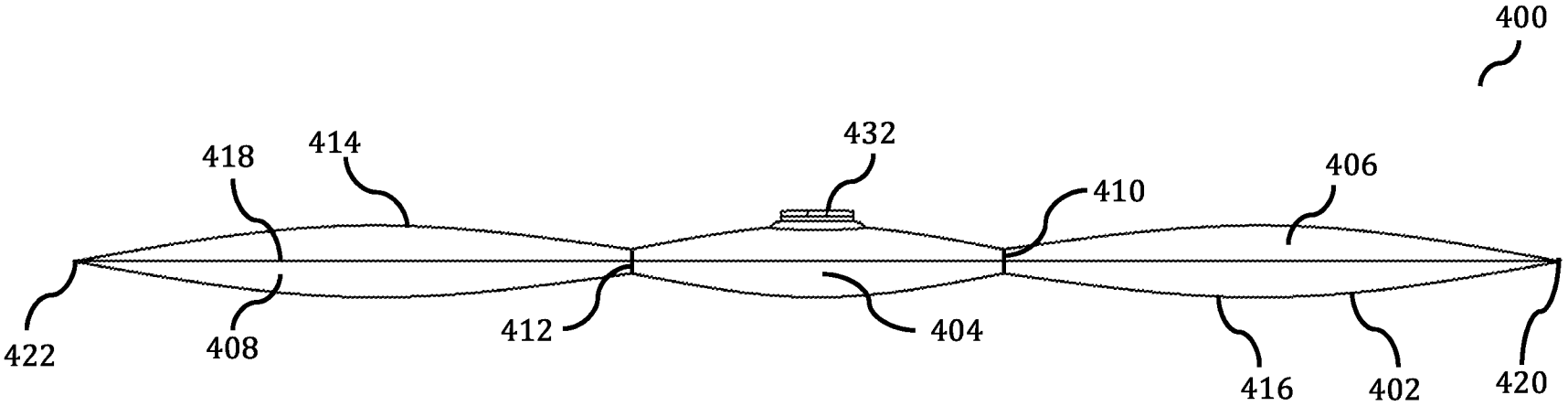

FIGS. 4A and 4B illustrate two opposite elevation views of the inflatable pillow 400 in a deflated (or substantially deflated) state—wherein each view comprises an elevation view with respect to a surface on which the deflated pillow 400 is resting. FIG. 4C illustrates a plan view of the pillow 400 in a deflated (or substantially deflated) state.

As shown in FIGS. 4A to 4C, pillow 400 comprises an elongate body 402—the elongate body 402 comprising a pair of wing sections 406, 408 and a bridge section 404 connecting wing sections 406, 408. The two wing sections 406, 408 are each connected to bridge section 404 in a laterally opposed configuration—such that a first wing section 406 extends from a right side of bridge section 404 laterally outward in a first direction (in a rightward direction) along a longitudinal axis "1", while a second wing section 408 extends from a left side of bridge section 404 laterally outward in an opposite second direction (in a leftward direction) along the longitudinal axis 1.

In an embodiment of the invention, pillow 400 is formed by two (or more) sheets 414, 416 of pliant or flexible airtight (i.e. substantially air impermeable) material joined along across the periphery of the elongate body 402 using one or more welds or airtight seams 418. The joining of the two sheets defines one or more air chambers between the sheets 414, 416—which air chamber(s) can be inflated to give pillow 400 an inflated configuration. Pillow 400 may additionally include one or more inflation valves 432 or inflation points through which air can be introduced into the air chamber for inflating the pillow. A desired shape or peripheral contour of pillow 400 may be achieved by appropriately shaping sheets 414, 416—either prior to or subsequent to the joining of the sheets. The shape of sheets 414, 416 that are joined together would define the shape of the air chamber created between the sheets. The air chamber so formed by the joined sheets 414, 416 may in an embodiment extend through (and connect) bridge section 404 and the two wing sections 406, 408 of pillow 400.

As shown in FIGS. 4A to 4C, pillow 400 additionally includes at least two air chamber constrictions 410 and 412 incorporated within elongate body 402. For the purposes of the present description the terms "air chamber constriction(s)" or "constriction(s)" shall be understood as referring to any feature or structure formed on or within pillow 400 which (i) blocks, prevents or interferes with passage of air from one region of an air chamber within pillow 400 to another region of the air chamber, when the pillow is being inflated, or (ii) joins sheets 414, 416 together at one or more regions located between opposing peripheral seams 110 and 112, or (iii) restricts or reduces or otherwise modifies the inflation responsive expansibility exhibited by of one or both of sheets 414, 416 in comparison with the inflation responsive expansibility exhibited by said one or both sheets 414, 416 in absence of said feature or structure, or (iv) reduces, restricts or interferes with inflation responsive separation of sheets 414, 416 relative to each other. As described in more detail below, the position, size, orientation and configuration of the constrictions 410 and 412 located within elongate body 402 of pillow 400 is selected to ensure that in an inflated resting position of pillow 400, each of wing sections 406 and 408 conforms to an angled orientation with respect to bridge section 404.

In an embodiment, the constrictions 410, 412 are positioned, sized, oriented and configured within elongate body 402 of pillow 400 so as to form a plurality of inflation actuatable hinges that enable pillow 400 to transition between (i) a deflated state in which the pillow conforms to a first substantially planar profile within at least one plane, and (ii) an inflated state in which the pillow conforms to a non-planar profile within the at least one plane—and preferably wherein in the inflated state each of wing sections 406 and 408 of pillow 400 are positioned in angled orientations with respect to bridge section 404. In one embodiment, each constriction is configured (i) such that when the pillow is an inflated state, the constriction(s) urge the pillow from a substantially planar profile within at least one plane to a non-planar profile within the at least one plane, and/or (ii) such that when the pillow is in an inflated state and has conformed to a non-planar profile within at least one plane, the constrictions resist transition of the pillow from the non-planar profile within the at least one plane towards a substantially linear profile within the at least one plane.

As discussed above, each of constrictions 410 and 412 within elongate body 402 comprises a feature, barrier or structure that (i) prevents, restricts or otherwise interferes with passage of air between portions of the an air chamber created between sheets 414, 416, when the pillow is being inflated, or (ii) joins sheets 414, 416 together at one or more regions located between opposing peripheral seams 110 and 112, or (iii) restricts or reduces or otherwise modifies the inflation responsive expansibility exhibited by of one or both of sheets 414, 416 in comparison with the inflation responsive expansibility exhibited by said one or both sheets 414, 416 in absence of said constriction(s), or (iv) reduces, restricts or interferes with inflation responsive separation of sheets 414, 416 relative to each other.

The constrictions of the present invention may be implemented within elongate body 402 in any number of different ways.

In one embodiment, any of constrictions 410, 412 within elongate body 402 may be created by creating a weld or air impermeable seam between sheets 414, 416 at a region where the constriction is intended to be created. The weld or air impermeable seam between sheets 414, 416 may be achieved in any number of ways, including without limitation, stitching, adhesives, welding (heat, resistance, RF, ultrasound, pressure) or a combination of any of the above.

In another embodiment, one or more of constrictions 410, 412 within elongate body 402 comprises an inwardly formed indentation or crease created on one or both of sheets 414, 416—for example an inwardly formed indentation, crease or deformation created by a heat seal applied to the external surface(s) of one or both of sheets 414, 416.

In particular embodiments of the invention, the one or more constrictions may be formed in configurations that predispose a wing section adjacent to said one or more constrictions to bend, curve or move towards a given direction or a given orientation relative to the bridge section responsive to pillow 400 being inflated. In one embodiment, the one or more constrictions may define a crease or a curve on or within pillow 400, which crease or curve either predisposes pillow 400 to bend along said crease or curve responsive to pillow 400 being in an inflated state, or which crease or curve resists pillow 400 bending in a direction opposed to said crease or curve when pillow 400 is in an inflated state.

In some non-limiting embodiments, each of constrictions 410 and 412 are configured to restrict, reduce, bar, resist or otherwise interfere with the passage of air (within the air chamber defined by sheets 414 and 416) between bridge section 404 and corresponding wing sections 406 and 408, when the pillow is being inflated. In other embodiments, each of constrictions 410 and 412 are configured to (i) join sheets 414, 416 together at one or more regions located between opposing peripheral seams 110 and 112, (ii) restrict, reduce or otherwise modify inflation responsive expansibility exhibited by of one or both of sheets 414, 416 in comparison with the inflation responsive expansibility exhibited by said one or both sheets 414, 416 in absence of said constriction(s), (iii) reduce, restrict or interfere with inflation responsive separation of sheets 414, 416 relative to each other, and/or (iv) define one or more crease(s) or curve(s) on or within pillow 400, which crease(s) or curve(s) either predispose pillow 400 to bend along said crease(s) or curve(s) responsive to pillow 400 being in an inflated state, or which crease(s) or curve(s) resists pillow 400 bending in a direction opposed to said crease or curve when pillow 400 is in an inflated state.

In certain non-limiting embodiments of the type illustrated in FIGS. 4A to 4G, each of constrictions 410 and 412 may be configured to create (i) an air impermeable region between the bridge section 404 and one of wing sections 406, 408 and (ii) one or more than one restricted width channels connecting bridge section 404 and the corresponding wing sections 406, 408 of pillow 400. In the embodiment illustrated in FIG. 4A, constriction 410 is sized and positioned to create an air impermeable region 424 between bridge section 404 and wing section 408, while simultaneously creating two restricted width channels 428 and 428' on either side of air impermeable region 424—which restricted width channels 428 and 428' form passages connecting bridge section 404 and wing section 408. Similarly, constriction 412 is sized and positioned to create an air impermeable region 426 between bridge section 404 and wing section 406, and creating two restricted width channels 430 and 430' on either side of air impermeable region 426 which restricted width channels 430 and 430' form air chamber passages connecting bridge section 404 and wing section 406.

In an embodiment, one or more of the restricted width channels created by the constrictions 410, 412 may be sized such that the width or cross-sectional area of the narrowest part of the restricted width channel(s) is smaller than (i) the width or cross-sectional area of the widest part of an adjacent wing section 404, 406 and/or (ii) the width or cross-sectional area of the widest part of bridge section 404.

In a further embodiment, the air impermeable region formed by any one of, or by each of, constrictions 410, 412 may be sized such that the width or cross-sectional area of the air impermeable region is smaller than (i) the width or cross-sectional area of the widest part of an adjacent wing section 404, 406 and/or (ii) the width or cross-sectional area of the widest part of bridge section 404.

The combination of a constriction 410, 412 created within the air chamber of inflatable pillow 400 (for example at a junction between the bridge section 404 and each of the wing sections 406, 408) and restricted width channels 428, 428', 430, 430' that together result in restriction or limitation of air chamber expansibility at constrictions 410, 412 in comparison with air chamber expansibility at the respective widest parts of bridge section 404 and wing sections 406, 408—result in formation of inflation actuatable hinge structures between the bridge section 404 and each wing section 406, 408, at and around each constriction 410, 412.

Responsive to inflation of pillow 400 (for example via an inflation valve or inflation point 432), the air chamber transitions to an expanded state (as a consequence of air delivered into the air chamber formed between sheets 414, 416)—such that each of bridge section 404 and wing sections 406 and 408 are in an expanded state and acquire a three dimensional form. By virtue of (i) the limited expansibility of the air chamber in the region of constrictions 410, 412 located at the junction(s) between the bridge section 404 and each wing section 406, 408, and (ii) the higher expansibility of said air chamber in regions located away from the constrictions 410, 412, said junctions are less rigid and more pliant than the bridge section 404 and adjacent wing section(s) 406, 408 when pillow 400 is in an inflated state. In more particular embodiments, by virtue of the constriction structures 410, 412, (i) when the pillow is an inflated state, the constrictions 410, 412 urge pillow 400 from a substantially planar profile within at least one plane to a non-planar profile within the at least one plane, (ii) when the pillow is in an inflated state and has conformed to a non-planar profile within at least one plane, constrictions 410, 412 resist transition of pillow 400 from the non-planar profile within the at least one plane towards a substantially linear profile within the at least one plane and/or (iii) one or more sections of pillow 400 are predisposed to bend in a predefined direction, shape or curve responsive to pillow 400 being in an inflated state, or to resists bending in a direction opposed to said predefined direction, shape or curve responsive to pillow 400 being in an inflated state.

It would be understood that when pillow 400 is deflated the junctions between bridge section 404 and wing sections 406, 408 exhibit substantially the same rigidity and/or pliancy as the bridge section 404 and adjacent wing section(s) 406, 408—whereas in an inflated state, said junctions exhibit a higher pliancy and lower rigidity in comparison with other portions of inflated pillow 400. This lower rigidity or higher pliancy that results in an inflated state of the pillow, can be a consequence of the lower compressibility of air relative to the compressibility of the material of sheets 414, 416. In an embodiment, the lower rigidity and higher pliancy results in the junctions buckling or folding when pillow 400 is in an inflated state—thereby forming a hinge at each of the junctions, and enabling each wing section 406, 408 to assume an angled orientation with respect to bridge section 404 when pillow 400 is in an inflated resting state.

In other embodiments, the implementation of constrictions 410, 412 at junctions between bridge section 404 and wing sections 406, 408 results in hinge regions configured (i) such that when the pillow is an inflated state, the constrictions 410, 412 urge pillow 400 from a substantially planar profile within at least one plane to a non-planar profile within the at least one plane, (ii) such that when the pillow is in an inflated state and has conformed to a non-planar profile within at least one plane, constrictions 410, 412 resist transition of pillow 400 from the non-planar profile within the at least one plane towards a substantially linear profile within the at least one plane. As discussed above, in one or more specific embodiments, the constrictions may include structure that defines a crease or a curve one or within pillow, which crease or curve predisposes pillow 400 to bend along said crease or curve responsive to pillow 400 being in an inflated state, or which crease or curve resists pillow 400 bending in a direction opposed to said crease or curve when pillow 400 is in an inflated state.

Figure 4D:
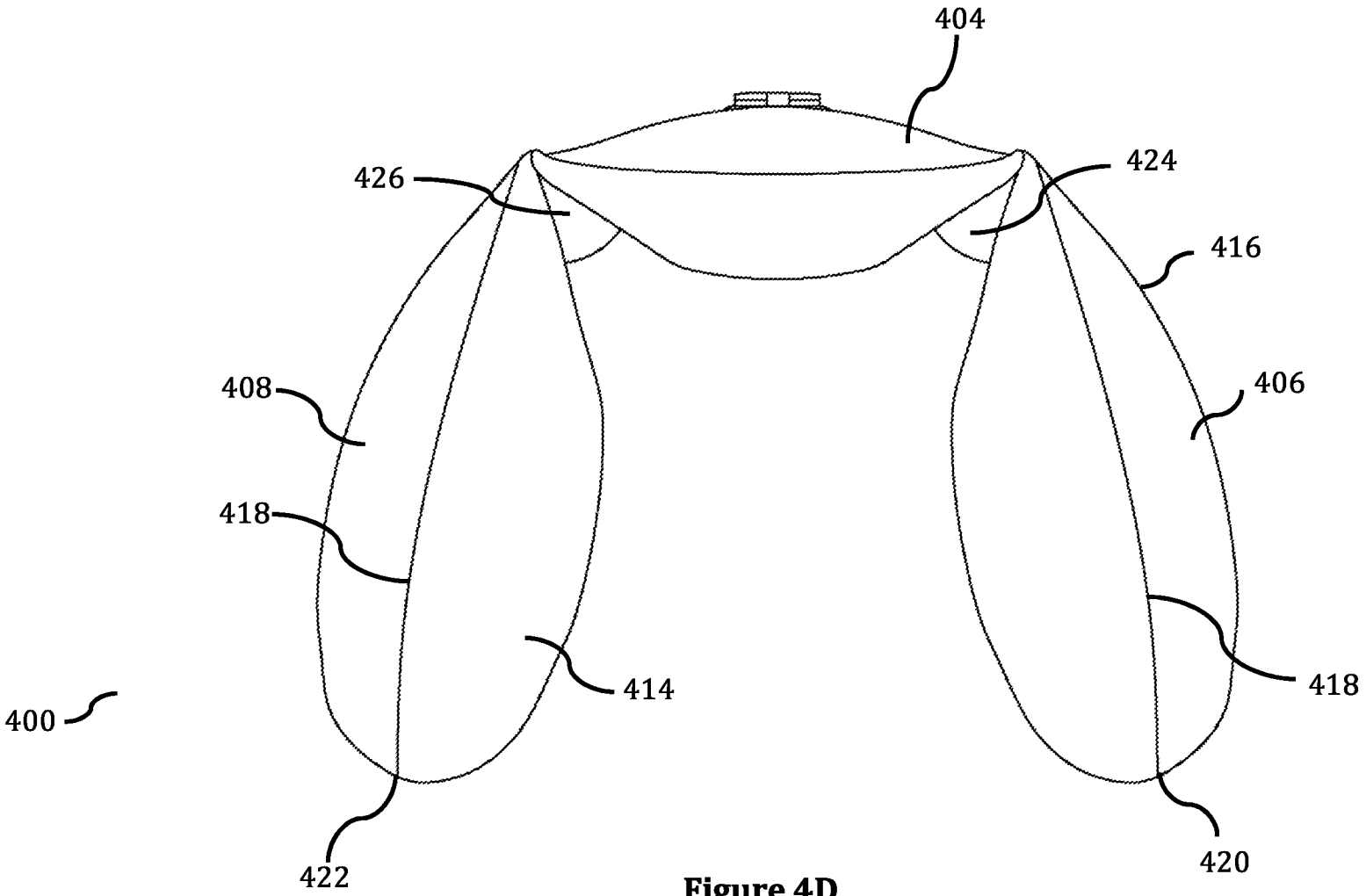

FIGS. 4C and 4D illustrate plan views of pillow 400 in inflated states, wherein wing sections 406, 408 have assumed angled orientations with respect to bridge section 404, thereby causing pillow 400 to transition from a substantially planar profile in its deflated state (as shown in the plan view of FIG. 4B) to a substantially u-shaped profile (as shown in the plan views of FIGS. 4C and 4D) in its inflated state.

Figure 4E:
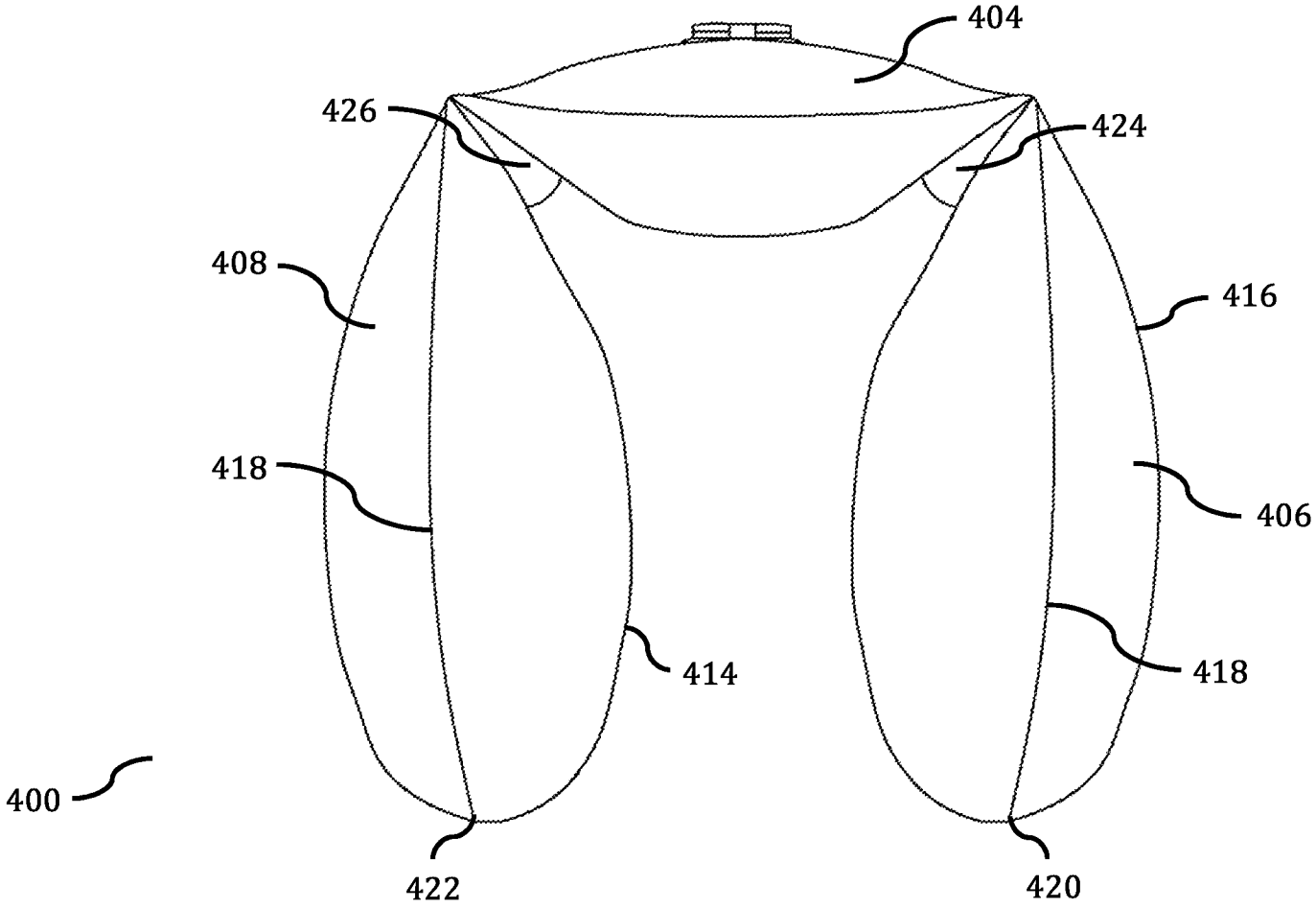
Figure 4F:
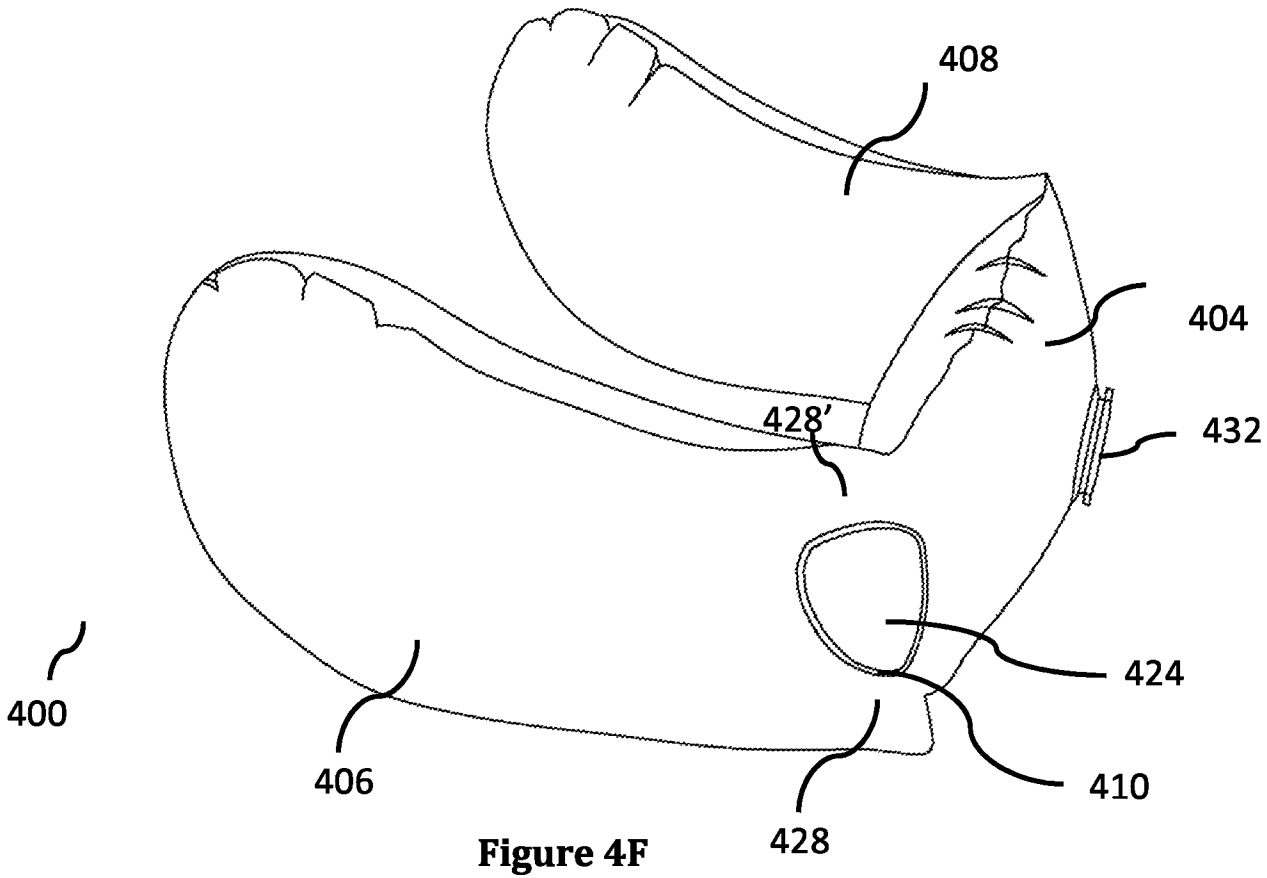
Figure 4G:
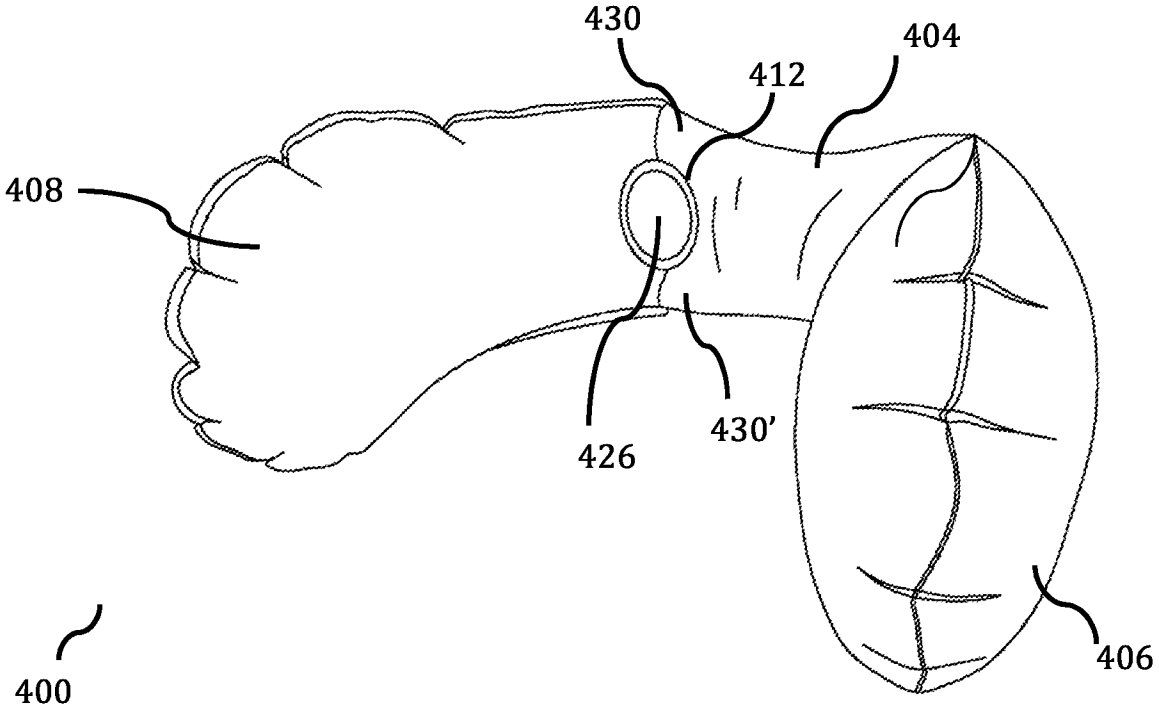

FIGS. 4E and 4F respectively show perspective views of inflatable pillow 400—and the manner in which the constrictions 410, 412, and optionally the corresponding air impermeable regions 424, 426 (that have been defined by constrictions 410, 412) and reduced width air channels 428, 428', 430 and 430', form inflation actuatable hinges at the junctions of bridge section 404 and wing section 406 and 408—thereby causing the pillow 400 to transition from a substantially planar configuration in a deflated state to a substantially u-shaped configuration in an inflated resting state.

While the constrictions 410, 412 illustrated in FIG. 4A are shown to be substantially elliptical, it would be understood that any other shape or configuration would also be effective provided the constrictions form any of (i) one or more welds or seams located between opposing peripheral seams 110 and 112 and joining portions of sheets 414, 416 together, or (ii) an air impermeable region between the bridge section and a wing section of the inflatable pillow, with one or more restricted width channels formed between the bridge section and the wing section or (iii) one or more constriction regions located at junction(s) of bridge section 404 and each of wing sections 406, 408, within which expansibility exhibited by one or both sheets forming the inflatable pillow is reduced in comparison with expansibility exhibited by the one or both sheets outside of (or away from) the constriction regions, or (iv) one or more structures that reduce, restrict or interfere with inflation responsive expansibility of one or both sheets relative to each other or (v) a cross-section restrictive region that reduces the cross-section of the air chamber within pillow 400 at junctions between the bridge section and the wing section(s), in comparison with a cross-section of either bridge section 404 or an adjacent wing section 406, 408 at its widest point, or (vi) one or more crease(s) or curve(s) on or within pillow 400, which crease(s) or curve(s) either predisposes pillow 400 to bend along said crease or curve responsive to pillow 400 being in an inflated state, or which crease or curve resists pillow 400 bending in a direction opposed to said crease or curve when pillow 400 is in an inflated state.

Figure 5A:
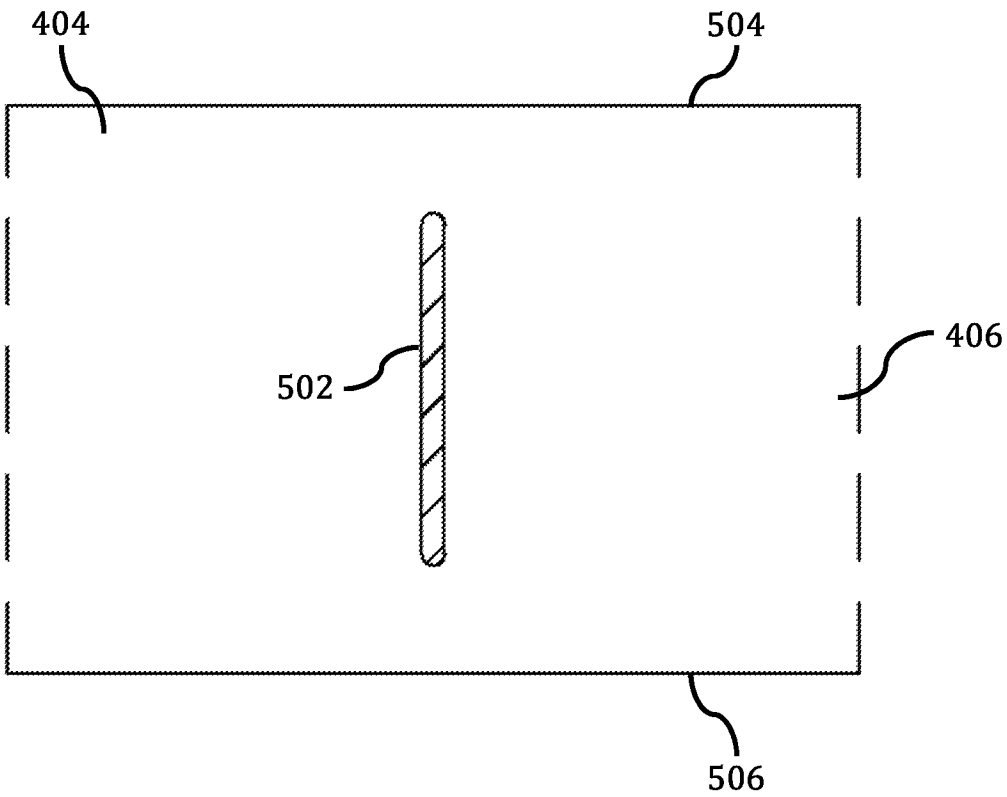
FIGS. 5A to 5E show alternate configurations for constrictions that may be implemented within the inflatable pillow of the present invention.
Figure 5B:
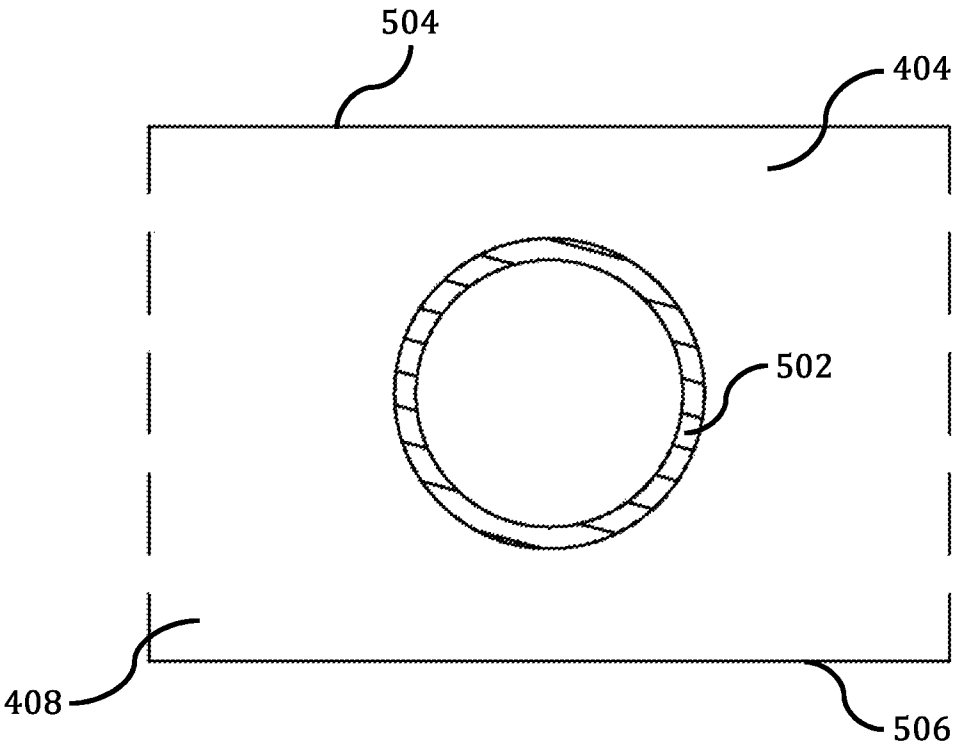
Figure 5C:
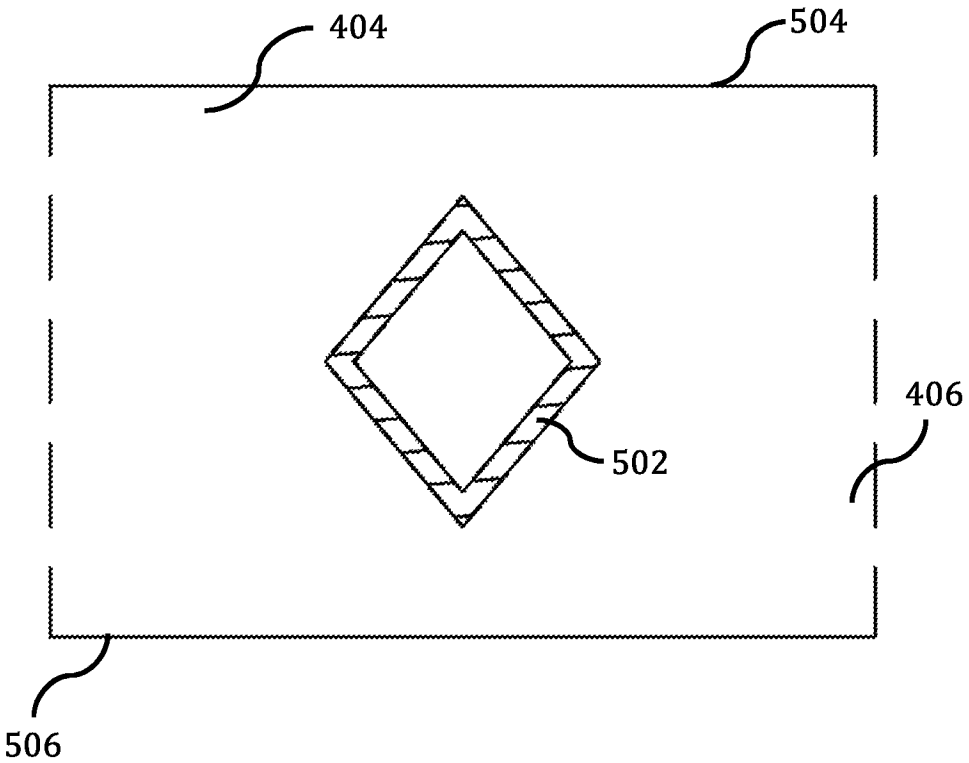

By way of example, FIGS. 5A to 5C respectively illustrate linear shaped, circular shaped and diamond shaped geometries for the constrictions 502 formed at junctions between bridge section 404 and wing sections 406, 408 of pillow 400—all of which have been found to form effective inflation actuatable hinges at the junctions of bridge section 404 and wing sections 406, 408 of an inflatable pillow 400. It has been found that varying the constriction geometries, including shape, width-height aspect ratio and size of the constrictions enables varying degrees of bending angles for the inflation actuatable hinge regions.

Figure 5D:
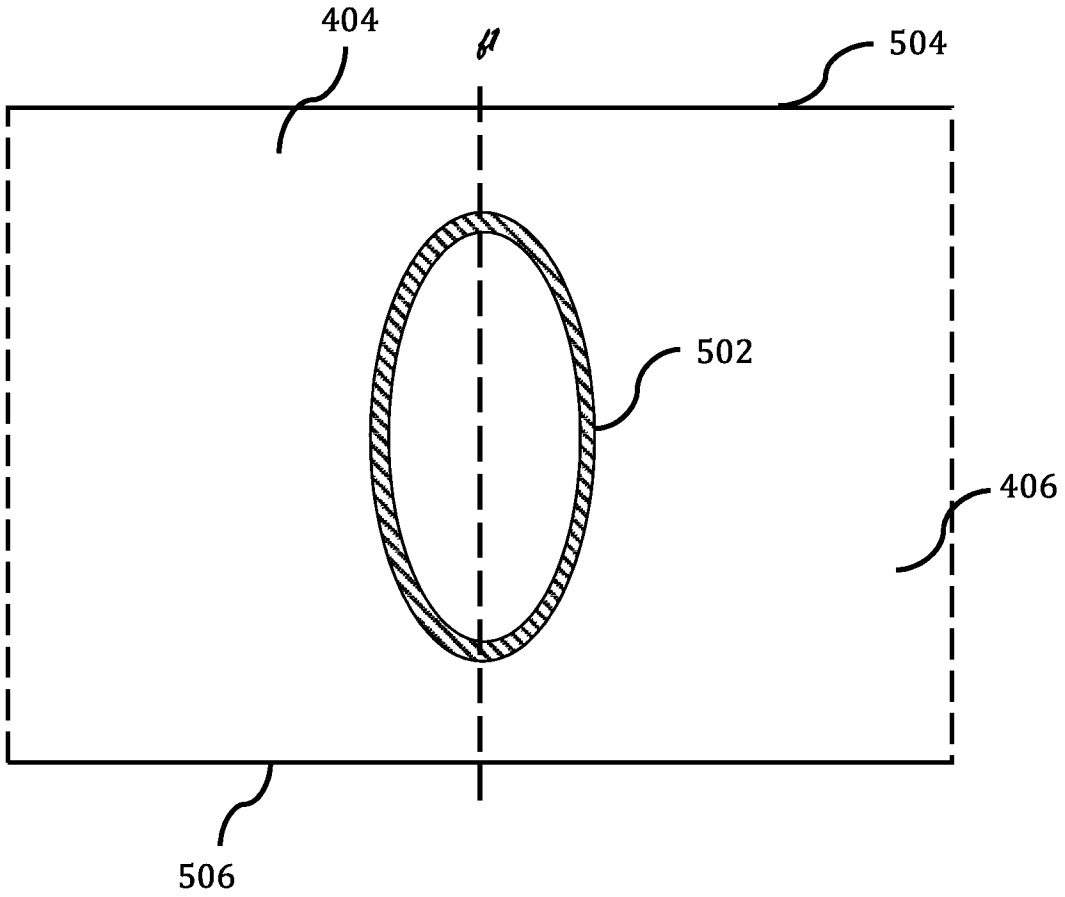
Figure 5E:
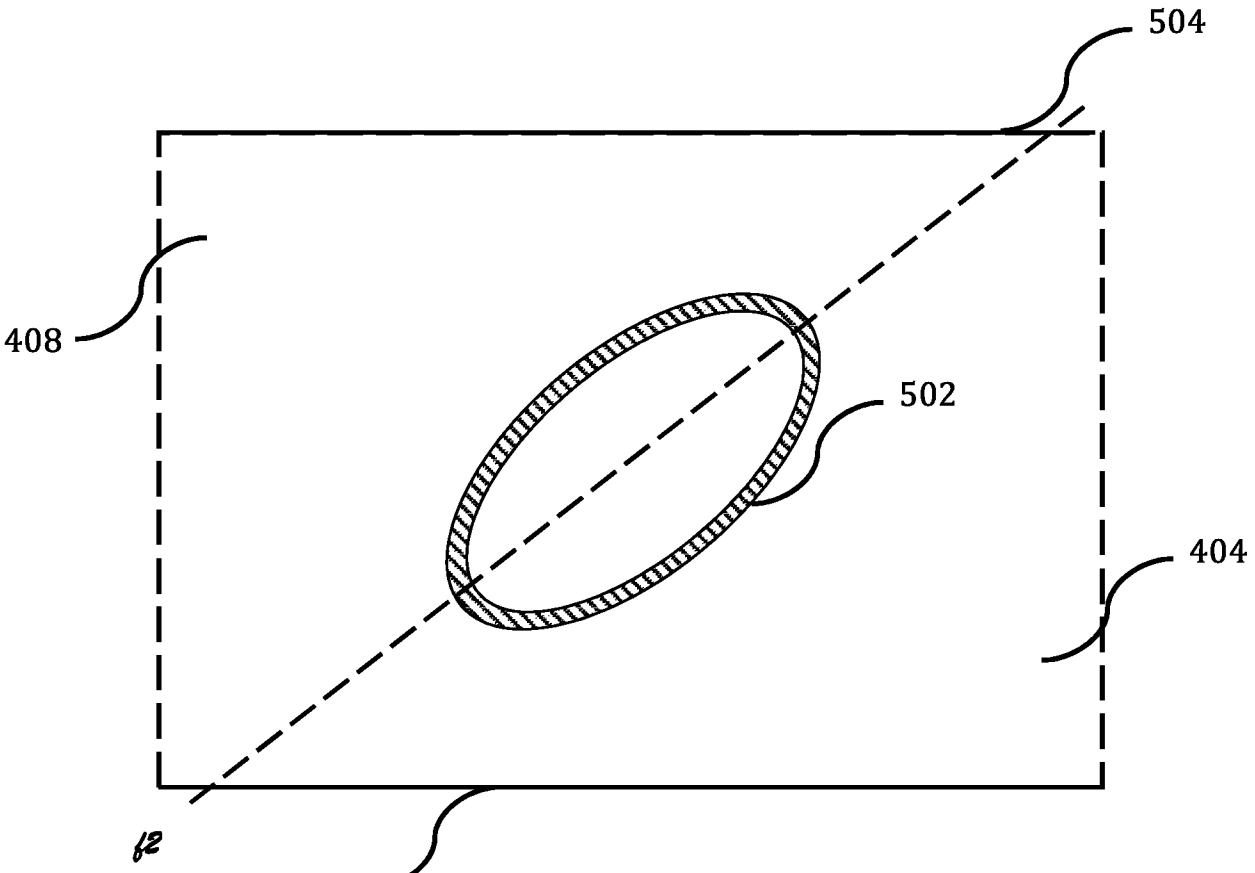

As illustrated in FIGS. 5D and 5E, varying the orientation of a constriction 502 relative to the peripheral edges 504, 506 of a pillow 400 can also be used to control the orientation, direction and degree of angular movement or orientation of wing sections 406, 408 relative to bridge section 404, when pillow 400 is in an inflated resting state. By way of example in FIG. 5D, the constriction 502 is elliptically shaped and positioned such that the major axis "f1" of the elliptical constriction is substantially perpendicular to the top and bottom peripheral edges 504, 506 of pillow 400, whereas in FIG. 5E, the elliptical construction is positioned such that the major axis "f2" is angled (i.e. is at a non-perpendicular angle) with respect to the top and bottom peripheral edges 504, 506 of pillow 400. As a consequence (i) in the embodiment of FIG. 5D, when pillow 400 is in an inflated resting state, the wing section 406 adjacent to the illustrated constriction 502 and the bridge section 404 would fold along the axis f1 that corresponds substantially to the major axis of the elliptical constriction—and would fold along an axis that is substantially perpendicular to the top and bottom peripheral edges of pillow 400, whereas (ii) in the embodiment of FIG. 5E, when pillow 400 is in an inflated resting state, the wing section 408 adjacent to the illustrated constriction 502 and the bridge section 404 would fold along the axis f2 that corresponds substantially to the major axis of the elliptical constriction—i.e. would fold along an axis that is angularly oriented (at a non-perpendicular angle) with respect the top and bottom peripheral edges 504, 506 of pillow 400.

Additionally, while one embodiment of pillow 400 (as shown in in FIG. 4A) provides restricted width channels 428, 428', and 430, 430' formed on either side of constrictions 410, 412 which connect the bridge section portion and wing section portions of the air chamber formed within pillow 400, in alternate embodiments, a restricted width channel connecting the air chamber between bridge section 404 and an adjacent wing section 406, 408 of inflatable pillow 400 may be formed only on one side of a constriction. In yet other embodiments, restricted width channel(s) connecting the air chamber between bridge section 404 and an adjacent wing section 406, 408 of inflatable pillow 400 may be formed through the respective constriction. It would be understood that the size, location and shape of the constrictions and corresponding restricted width channels may in certain embodiments, be varied to achieve a required flexibility of the inflation actuatable hinge(s), to control the extent to which the wing sections 406, 408 can be angled relative to the bridge section 404 of the inflatable pillow 400 when in an inflated resting state, and additionally to control the predisposition of the wing sections to move towards each other when the inflatable pillow 400 is in a fully inflated or inflated resting state.

Figure 6:
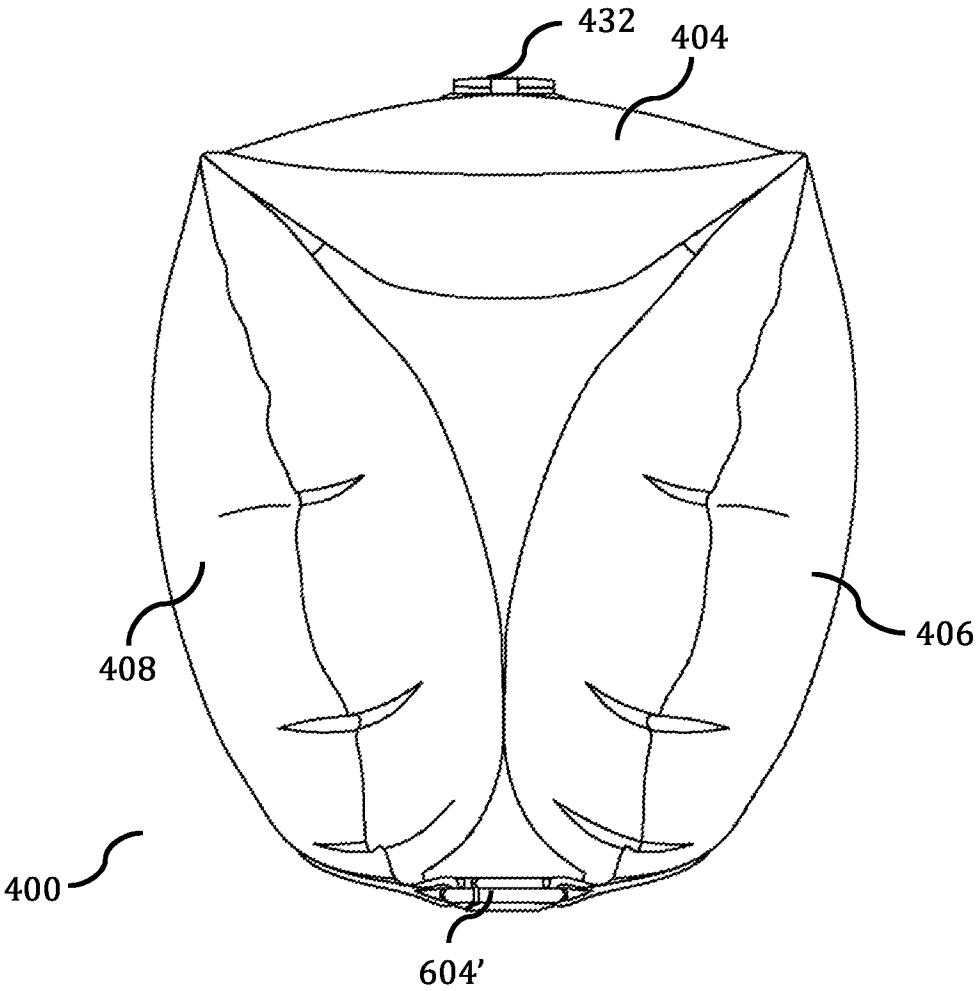

FIG. 6 illustrates a detailed plan view of an embodiment of inflatable pillow 400 in an inflated state, wherein the inflatable pillow 400 is provided with an inflation valve 432 on bridge section 404. It would however be understood that the inflation valve could alternatively be located on either of wing sections 406, 408. The inflatable pillow 400 may additionally have a closure 604 provided therein, which closure is configured to removably affix or to urge the respective opposite ends 420, 422 of wing sections 406 and 408 together. While the closure 604 illustrated in FIG. 6 comprises a strap and clasp arrangement, any other closure or fastener including without limitation a button-clasp, magnetic clasp or velcro closure would be equally effective. The objective of incorporating a closure at the ends of wing sections 406, 408 of pillow 400 is to permit the pillow to be securely fastened around a user's neck in an inflated state.

Figure 7:
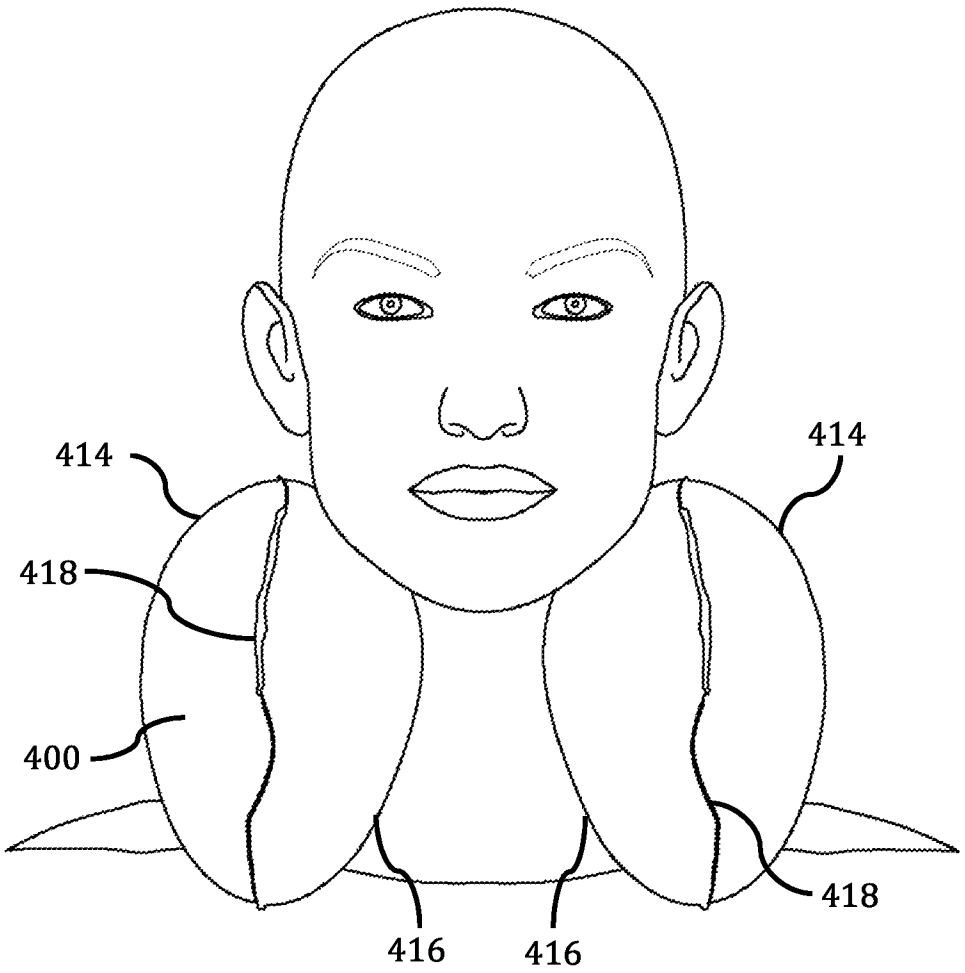
FIGS. 7 to 9 illustrate embodiments of the inflatable pillow of the present invention in use.

As shown in FIG. 7, in use, pillow 400 achieves a substantially u-shaped configuration when in an inflated state, while ensuring that the welds or seams 418 that have been used to join flexible sheets 414 and 416 together do not come in contact with the user's neck or other anatomy.

Figure 8:
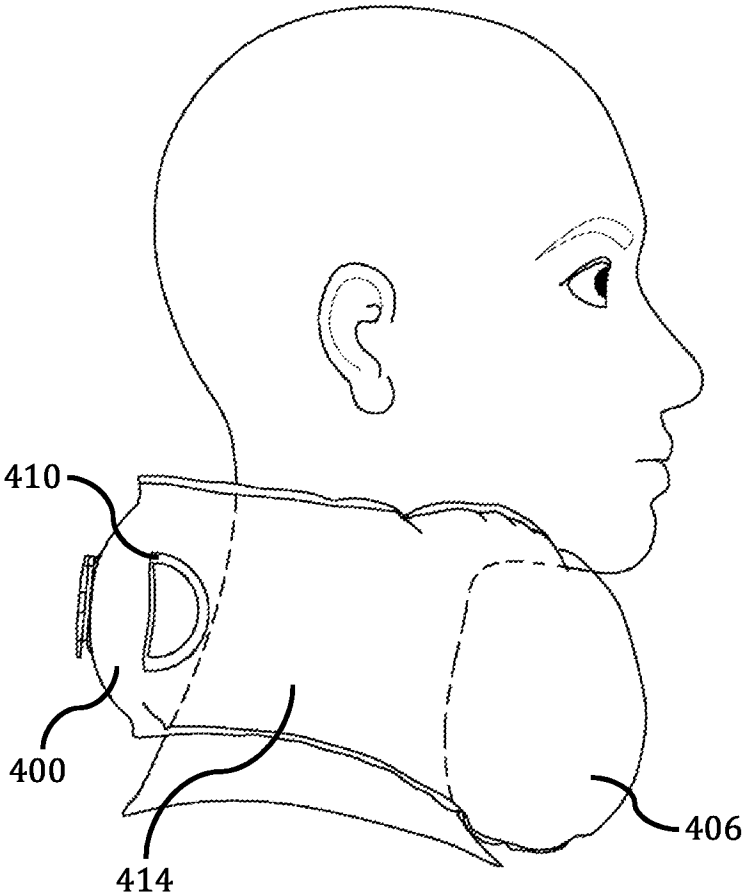
Figure 9:
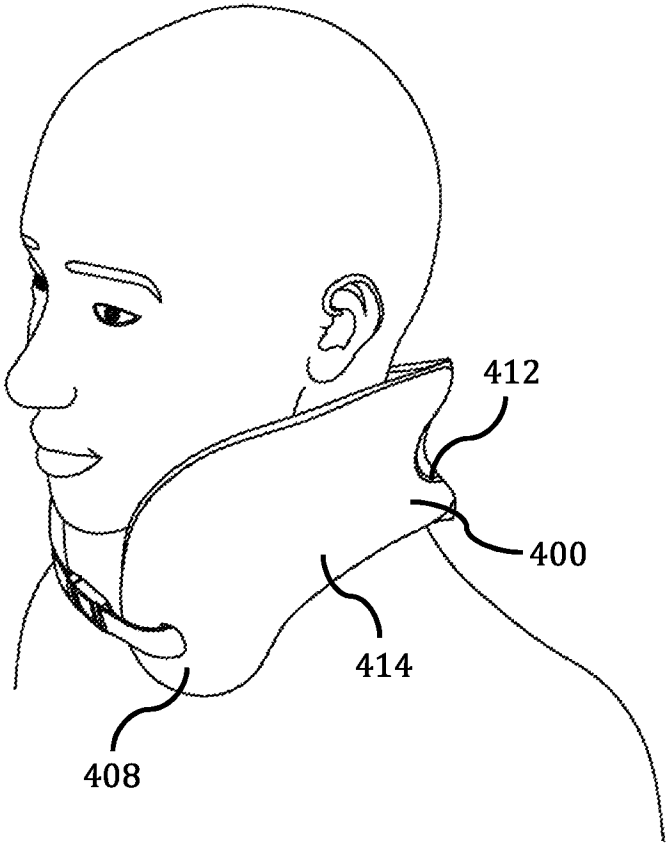

Additionally, as shown in FIGS. 8 and 9, appropriate shaping of sheets 414 and 416 that are affixed together to form inflatable pillow 400 enables selective contouring of the vertical profile of the pillow—which contouring can ensure that in an inflated state, the top and bottom peripheries of inflatable pillow 400 have different contours. This enables the vertical profile of inflatable pillow 400 to be configured for improving shape conformity of pillow 400 (when in an inflated state) with the facial, neck, head and shoulder anatomy of users.

It would be understood that structurally, the shape of sheets 414, 416, the welds affixing the sheets together, and the construction, size, location and orientations of the constrictions 410, 412, corresponding air impermeable regions 424, 426 and restricted width channels 428, 428', 430, 430' that connect bridge section 404 to wing sections 406, 408, influences the shape, horizontal and vertical profiles, and inflation actuatable behaviour of pillow 400. In an embodiment of the invention, a distance between the first constriction 410 and a furthest point on the periphery of adjacent wing 406 is the same or substantially the same as a distance between the second constriction 412 and a furthest point on the periphery of adjacent wing 408.

During manufacture, front and back sheets 414, 416 may be layered together before being connected by connection means such as stitching, adhesive, welding (heat, resistance, RF, ultrasound) or a combination of the above to create the welds. The welds themselves may define the shape of the pillow 400, the size, position, shape and orientation of constrictions 410, 412, and the, size, position, location and orientation of the corresponding air impermeable regions 424, 426 and restricted width channels 428, 428', 430, 430' that connect bridge section 404 to wing sections 406, 408. After sheets 414, 416 are welded together, excess material may be trimmed from sheets 414, 416 to leave a footprint of material as shown in any of FIGS. 4A to 9.

The pillow 400 may be constructed of any suitable material, including without limitation, polyvinylchloride (PVC). The pillow 400 may be assembled from individual sheets, or from a single sheet, folded over. The pillow 400 may additionally include a fabric cover disposed over the air impermeable sheets 414, 416.

It would be understood that while the above disclosure describes the invention in terms of an air inflatable pillow, the description is equally applicable to inflation by any other fluid, and references to the term "air" shall be understood to mean "air or any other fluid".

While the exemplary embodiments of the present invention are described and illustrated herein, it will be appreciated that they are merely illustrative. It will be understood by those skilled in the art that various modifications in form and detail may be made therein without departing from or offending the spirit and scope of the invention as defined by the appended claims. Additionally, the invention illustratively disclose herein suitably may be practiced in the absence of any element which is not specifically disclosed herein—and in a particular embodiment that is specifically contemplated, the invention is intended to be practiced in the absence of any one or more element which are not specifically disclosed herein.

What is claimed is:

1. A pillow, comprising:

at least two flexible sheets joined together to form a pillow body comprising at least a bridge, a first wing and a second wing, the joined flexible sheets defining an internal fluid chamber extending through the bridge and the first and second wings;

a first inflation actuatable hinge formed at a first junction between the bridge and the first wing, wherein the first junction is configured to buckle when the pillow is inflated to transition the first wing from a linear profile, disposed within at least one plane with the bridge, to an angled orientation relative to the bridge, the first inflation actuatable hinge comprising a first constriction structure configured to form a first restricted cross section region within the internal fluid chamber at the first junction between the bridge and the first wing, wherein an internal cross-sectional area of a narrowest part of the first restricted cross section region is smaller than an internal cross sectional area of at least one of the widest part of the bridge and the widest part of the first wing; and a second inflation actuatable hinge formed at a second junction between the bridge and the second wing, wherein the second junction is configured to buckle when the pillow is inflated to transition the second wing from the linear profile, disposed within the at least one plane with the bridge, to an angled orientation relative to the bridge, the second inflation actuatable hinge comprising a second constriction structure configured to form a second restricted cross section region within the internal fluid chamber at the second junction between the bridge and the second wing, wherein an internal cross-sectional area of a narrowest part of the second restricted cross section region is smaller than an internal cross sectional area of at least one of the widest part of the bridge and the widest part of the second wing;

wherein:

in a deflated state of the pillow, the bridge and the first and second wings conform to the linear profile within the at least one plane;

in an inflated state of the pillow, each of the first and second wing, in the respective angled orientation, is oriented at a non-zero angle relative to the bridge;

the first and second inflation actuatable hinges are configured to enable the pillow to transition between the deflated state and the inflated state; and the first and second inflation actuatable hinges are configured such that when the pillow is in the inflated state, one or both of the first and second inflation actuatable hinges resist transition of at least one of the first and second wings from the respective angled orientation to the linear profile.

2. The pillow as claimed in claim 1, wherein the first and second inflation actuatable hinges are configured such that when the pillow is in the inflated state, one or both of the first and second inflation actuatable hinges urge at least one of the first and second wings to the respective angled orientation.

3. The pillow as claimed in claim 2, wherein the first and second inflation actuatable hinges are configured such that when the pillow is in the inflated state, the first and second wings are urged to move towards each other.

4. The pillow as claimed in claim 1, wherein one or both of the first and second inflation actuatable hinges are configured to join the flexible sheets together at one or more regions located between opposing peripheral seams of the pillow.

5. The pillow as claimed in claim 1, wherein one or both of the first and second inflation actuatable hinges are configured to modify inflation responsive expansibility exhibited by of one or both of the flexible sheets in comparison with the inflation responsive expansibility exhibited by said one or both sheets in absence of the respective first and second inflation actuatable hinges.

6. The pillow as claimed in claim 1, wherein one or both of the first and second inflation actuatable hinges are configured to restrict inflation responsive separation of the flexible sheets relative to each other.

7. The pillow as claimed in claim 1, wherein responsive to the pillow being in the inflated state, one or both of the first and second inflation actuatable hinges predispose the pillow body to bend in a specific orientation.

8. The pillow as claimed in claim 1, wherein responsive to the pillow being in the inflated state, one or both of the first and second inflation actuatable hinges predispose the pillow body to resist bending away from a specific orientation.

9. The pillow as claimed in claim 1, wherein:

the first inflation actuatable hinge is configured such that in the deflated state of the pillow, pliancy of the pillow body at the first inflation actuatable hinge is substantially equal to pliancy of at least one of the bridge and the first wing; and the second inflation actuatable hinge is configured such that in the deflated state of the pillow, pliancy of the pillow body at the second inflation actuatable hinge is substantially equal to pliancy of at least one of the bridge and the second wing.

10. The pillow as claimed in claim 1, wherein each of the first inflation actuatable hinge and the second inflation actuatable hinge defines at least one additional restricted cross section region within the internal fluid chamber at a junction between the bridge and an adjacent first wing or second wing, such that an internal cross-sectional area of a narrowest part of the additional restricted cross-section region is smaller than a cross sectional area of at least one of the widest part of the bridge and the widest part of the adjacent wing.

11. The pillow as claimed in claim 1, wherein each of the first inflation actuatable hinge and the second inflation actuatable hinge comprises a fluid impermeable structure formed between the two flexible sheets.

12. The pillow as claimed in claim 11, wherein the fluid impermeable structure comprises a fluid impermeable weld joining the two flexible sheets.

13. The pillow as claimed in claim 1, wherein each of the first inflation actuatable hinge and the second inflation actuatable hinge comprises an inwardly formed indentation on one or both of the two flexible sheets.

14. The pillow as claimed in claim 1, wherein a distance between the first inflation actuatable hinge and a furthest point on a periphery of the first wing is equal to a distance between the second inflation actuatable hinge and a furthest point on a periphery of the second wing.

15. The pillow as claimed in claim 1, wherein the pillow body is an elongate body, and the first and second wings are each connected to the bridge in a laterally opposed configuration.

16. The pillow as claimed in claim 1, comprising one or more of:

an inflation inlet; and a closure configured to enable edges of the first wing and the second wing to be removably affixed together.

17. The pillow as claimed in claim 1, wherein the first inflation actuatable hinge protrudes between the bridge and the first wing at the first junction between the bridge and the first wing.

18. The pillow as claimed in claim 17, wherein the second inflation actuatable hinge protrudes between the bridge and the second wing at the second junction between the bridge and the second wing.

* * * * *